US007370649B2

(12) United States Patent
Gama et al.

(10) Patent No.: US 7,370,649 B2
(45) Date of Patent: May 13, 2008

(54) COOKING STOVE

(75) Inventors: Atsuhito Gama, Nagoya (JP); Shinichiro Hata, Nagoya (JP); Hiroyuki Yamada, Nagoya (JP); Kazuya Hirota, Nagoya (JP)

(73) Assignee: Rinnai Corporation, Nagoya-shi (JP)

( * ) Notice: Subject to any disclaimer, the term of this patent is extended or adjusted under 35 U.S.C. 154(b) by 547 days.

(21) Appl. No.: 11/130,281

(22) Filed: May 17, 2005

(65) Prior Publication Data

US 2005/0257785 A1 Nov. 24, 2005

(30) Foreign Application Priority Data

May 18, 2004 (JP) ..... 2004-147251

(51) Int. Cl.
*F24C 3/00* (2006.01)
*H05B 3/68* (2006.01)

(52) U.S. Cl. ..... 126/393 A; 126/39 E; 219/445.1; 219/446.1; 219/447.1; 219/448.11; 219/448.12; 219/448.13; 431/24; 431/66; 431/67; 431/68; 700/90

(58) Field of Classification Search ..... 219/446.1, 219/447.1, 448.11, 448.12, 448.13, 445.1; 126/39 BA, 39 E; 431/18, 24–5, 27, 29, 431/66–73; 700/90
See application file for complete search history.

(56) References Cited

U.S. PATENT DOCUMENTS

| | | | |
|---|---|---|---|
| 5,241,463 | A | 8/1993 | Lee |
| 2002/0162730 | A1 | 11/2002 | Gremm et al. |
| 2004/0069293 | A1 | 4/2004 | Steurer |

FOREIGN PATENT DOCUMENTS

| | | | |
|---|---|---|---|
| JP | 2003-272816 | A | 9/2003 |

*Primary Examiner*—Shawntina Fuqua
(74) *Attorney, Agent, or Firm*—Birch, Stewart, Kolasch & Birch, LLP

(57) ABSTRACT

A touch switch which prohibits a child from actuating heating means, while permitting a child to deactivate heating means. A cooking stove including an electrical capacitance operation switch 10 which switches the cooking stove between an operation state in which an ignition instruction is enabled and a standby state in which the ignition instruction is disabled; the operation switch is used to instruct the cooking stove to be extinguished. When the cooking stove is inactive, a switch circuit 63 selects a resistance element 61 offering a higher resistance to set the cooking stove in a "lower sensitivity set state" in which the operation switch 10 has a sensitivity sl. When the cooking stove is active, the switch circuit 63 selects a resistance element 62 offering a lower resistance to set the cooking stove in a "higher sensitivity set state" in which the operation switch 10 has a sensitivity sh (>sl).

2 Claims, 8 Drawing Sheets

COOKING STOVE

BACKGROUND OF THE INVENTION

1. Field of the Invention

The present invention relates to a cooking stove comprising heating means, and in particular, to a cooking stove comprising an electrical capacitance touch switch allowing a user to instruct the heating means to be actuated.

2. Description of the Related Art

A cooking stove has hitherto been known which has heating means such as an induction heating coil accommodated below a top plate made of heat resistant glass, to heat a material to be cooked placed on the top plate, wherein an electrical capacitance touch switch constitutes an operation switch for instructing the heating means to be actuated (see, for example, Japanese Patent Laid-Open No. 2003-272816).

The top plate can be flat by employing the electrical capacitance touch switch as an operation switch as described above. This prevents the operation switch from obstructing cooking, thus allowing a user to use the cooking stove more easily and efficiently.

However, if the electrical capacitance touch switch is employed as an operation switch for instructing the heating means to be actuated, it is not necessary to operate the switch with a somewhat strong force as in the case of a pushbutton switch or a rotary switch. Thus, even when a child, who cannot exert a strong force, plays with or inadvertently touches the touch switch for instructing the heating means to be actuated, the touch switch disadvantageously changes from a non-sensing state to a sensing state to start actuating the heating means.

Here, the electrical capacitance touch switch changes from the non-sensing state to the sensing state when an electrostatic object having a capacitance exceeding a predetermined threshold value contacts or approaches a touch area. Thus, the threshold value may be set at a level such that the touch switch does not change from the non-sensing state to the sensing state when a finger of a child, who has a lower capacitance, touches the touch area and changes from the non-sensing state to the sensing state only when an adult's finger, which has a higher capacitance than the child's, contacts the touch area.

However, when the single touch switch is used to instruct the heating means to be actuated and stopped, if the sensitivity of the touch switch is lowered as described above, a child's operation of the touch switch is not accepted even when the touch switch is operated while the heating means is in operation to stop the heating means. Consequently, it is impossible to ask the child to stop the heating means.

It is thus an object of the present invention to provide a cooking stove comprising a touch switch that can prohibit a child from instructing the heating means to be actuated, while permitting a child to instruct the heating means to be stopped.

SUMMARY OF THE INVENTION

The present invention has been made to accomplish the above object. The present invention relates to improvements in a cooking stove comprising heating means, an electrical capacitance touch switch provided on a front panel of a cooking stove main body accommodating the heating means or on a top plate covering a top surface of the cooking stove main body, the touch switch allowing a user to instruct the heating means to switch from a stopped state to an actuated state and to instruct the heating means to switch from the actuated state to the stopped state, and heating control means for executing a process for actuating the heating means when the touch switch switches from a non-sensing state to a sensing state while the heating means is in the stopped state and executing a process for stopping the heating means when the touch switch switches from the non-sensing state to the sensing state while the heating means is in the actuated state.

The cooking stove is characterized by further comprising switch sensitivity varying means for, while the heating means is in the stopped state, setting the touch switch in a lower sensitivity set state in which the touch switch switches from the non-sensing state to the sensing state when an electrostatic object having a capacitance equal to or larger than a predetermined first reference value contacts or approaches a touch area, and while the heating means is in the actuated state, setting the touch switch in a higher sensitivity set state in which the touch switch switches from the non-sensing state to the sensing state when an electrostatic object having a capacitance equal to or larger than a predetermined second reference value contacts or approaches the touch area, the second reference value being smaller than the first reference value.

According to the present invention, the switch sensitivity varying means sets the touch switch in the lower sensitivity set state while the heating means is in the stopped state. The switch sensitivity varying means sets the touch switch in the higher sensitivity set state while the heating means is in the actuated state. Thus, when the electrostatic object touches the touch switch, the lower limit of the capacitance of the electrostatic object below which the touch switch changes from the non-sensing state to the sensing state is set to the first reference value while the heating means is in the stopped state. The lower limit is set to the second reference value which is smaller than the first reference value while the heating means is in the actuated state. This makes it possible to set the touch switch as follows. In the lower sensitivity set state, when a finger of a child, who has a lower capacitance, touches the touch area of the touch switch, the touch switch is maintained in the non-sensing state to prohibit execution of a process for starting actuating the heating means. In contrast, in the higher sensitivity set state, when a finger of a child touches the touch area of the touch switch, the touch switch changes from the non-sensing state to the sensing state to execute a process for stopping the heating means.

The cooking stove is also characterized in that the touch switch comprises a touch area set at a predetermined position on the front panel or the top plate, an electrode having a gap and provided opposite to the touch area via the front panel or the top plate, a resistance element connected to the electrode, and an oscillation circuit which outputs a pulse signal of a frequency corresponding to a time constant obtained by multiplying a capacitance within the electrode by a resistance value for the resistance element, the capacitance varying depending on the capacitance of the electrostatic object contacting or approaching the touch area, in order to sense the electrostatic object contacting or approaching the touch area by comparing the frequency of the pulse signal with a preset reference frequency, and the switch sensitivity varying means varies the resistance value for the resistance element to switch between the lower sensitivity set state and the higher sensitivity set state.

According to the present invention, a variation in the resistance value of the resistance element connected to the electrode varies the frequency of the pulse signal output by the oscillation circuit when an electrostatic object having a certain capacitance contacts the touch area of the touch switch. Thus, a variation in the resistance value of the resistance element varies the level of the capacitance of the electrostatic object for which the frequency of the pulse signal is used as the reference. This enables the touch switch to change between the lower sensitivity set state and the higher sensitivity set state.

DETAILED DESCRIPTION OF THE PREFERRED EMBODIMENT

Figure 1:
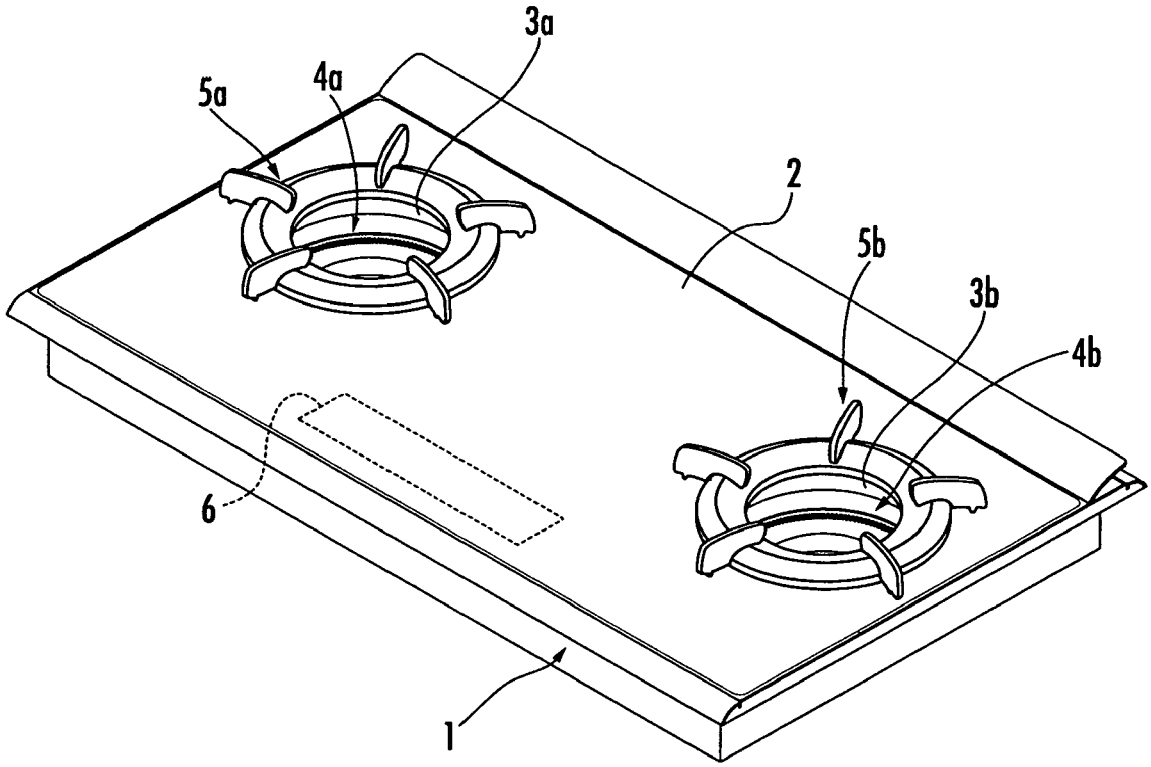
FIG. 1 is a diagram showing the appearance of a cooking stove according to the present invention.
Figure 2:
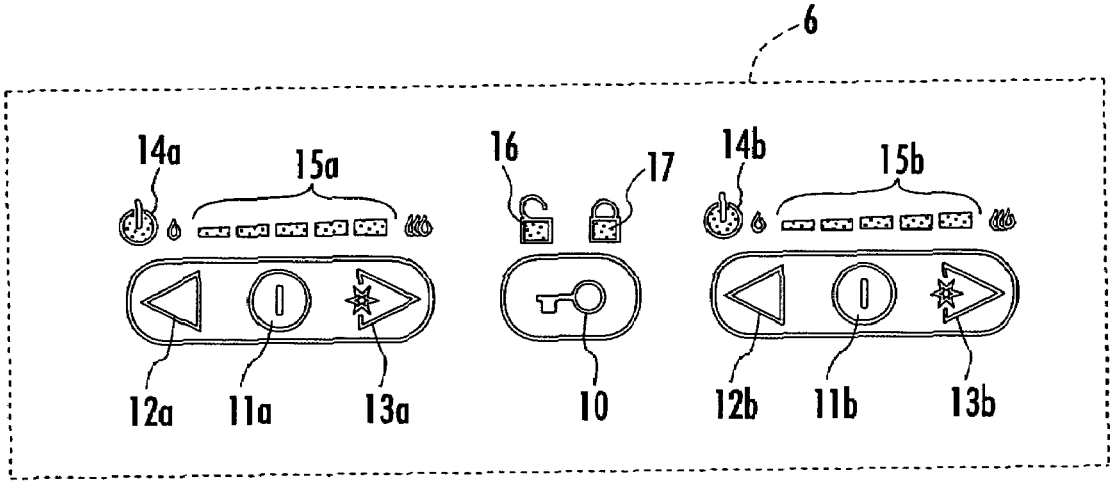
FIG. 2 is a diagram showing the arrangement of touch switches and display portions provided on a surface of a glass top plate.
Figure 3:
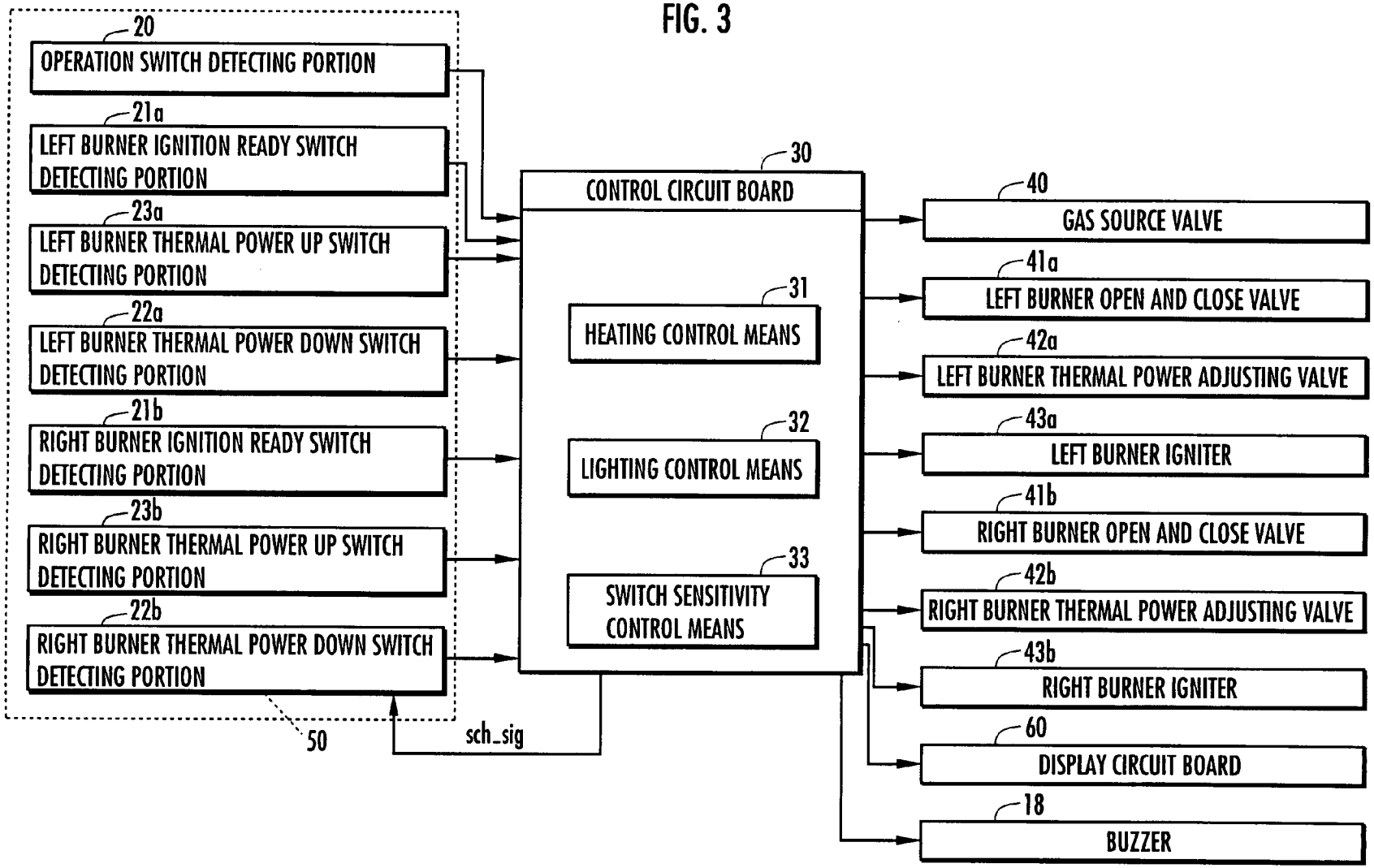
FIG. 3 is a block diagram of control performed in the cooking stove.
Figure 4:
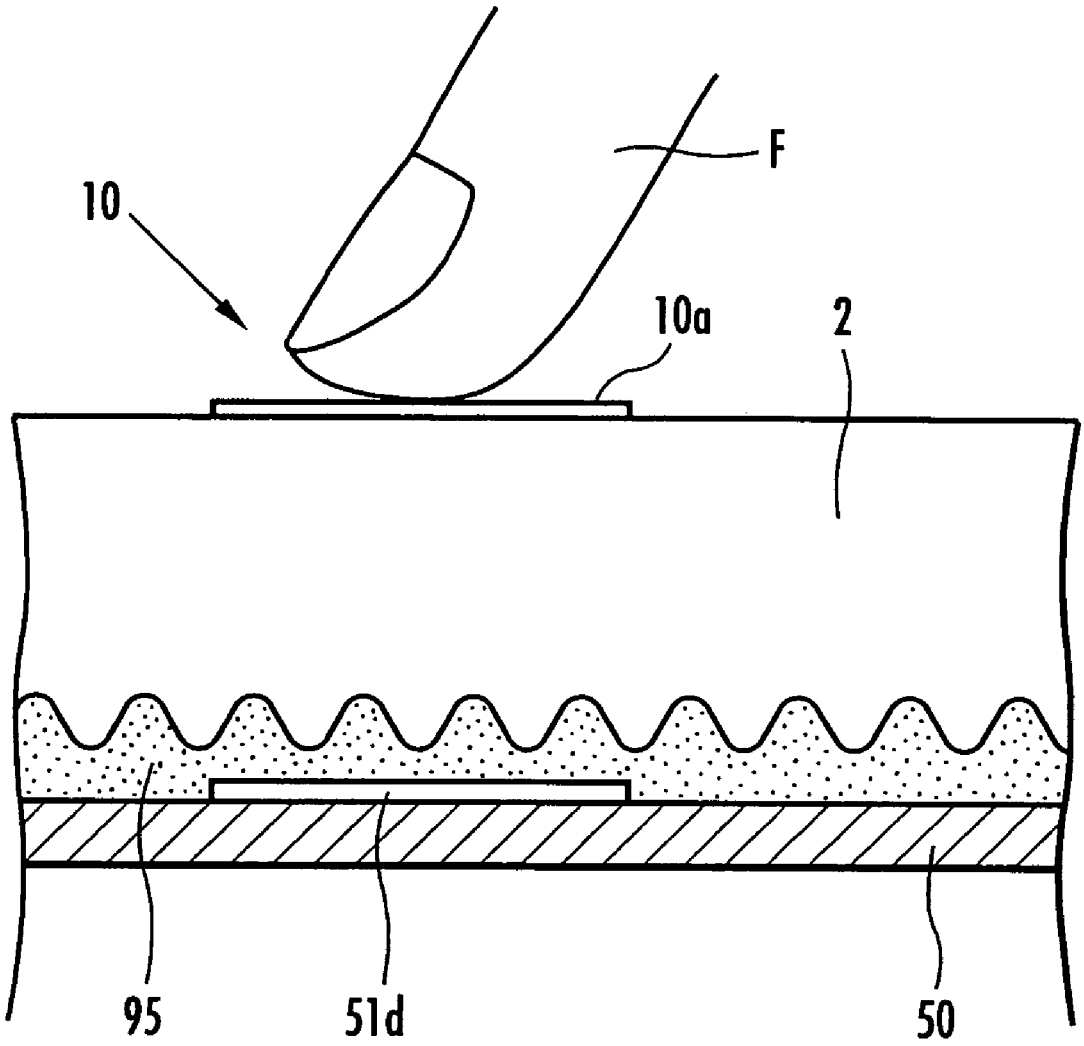
FIG. 4 is a sectional view of a touch switch.
Figure 5:
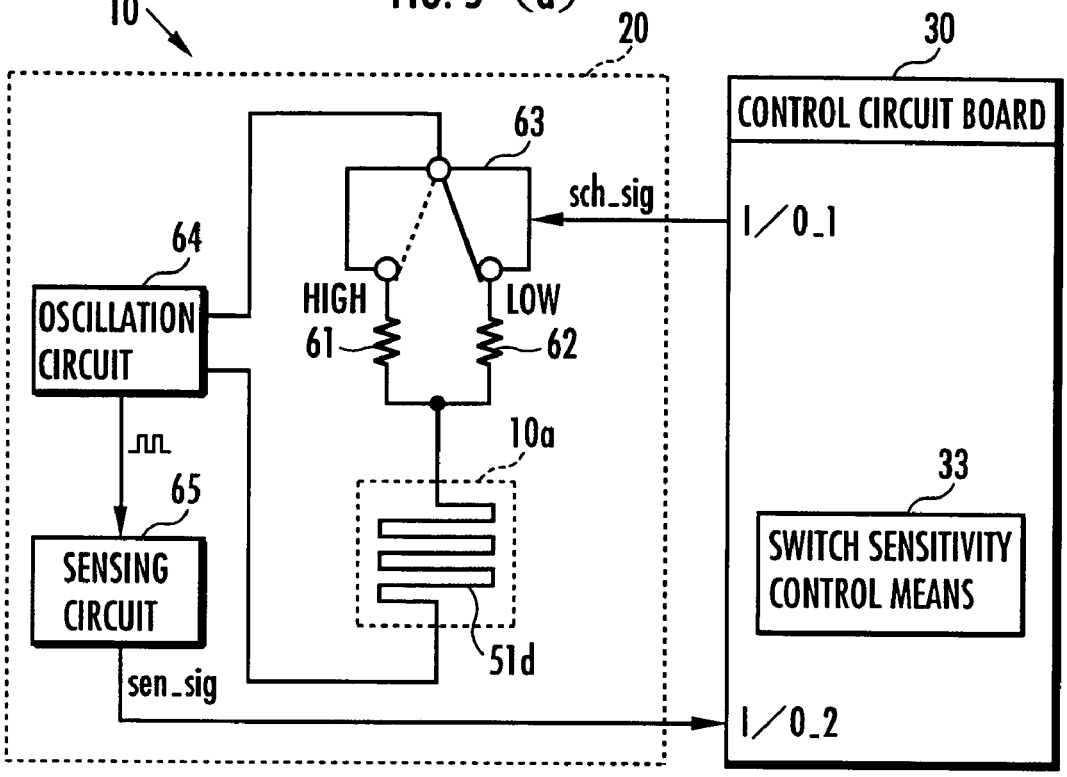
FIG. 5 is a diagram showing the configuration of the touch switch.
Figure 5:
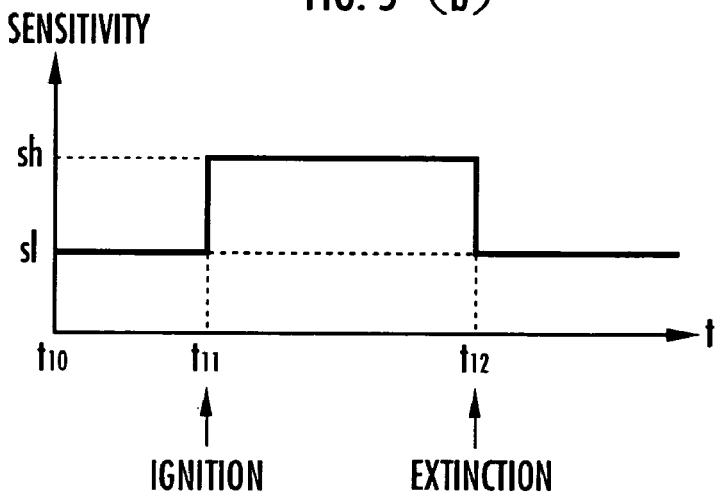
Figure 6:
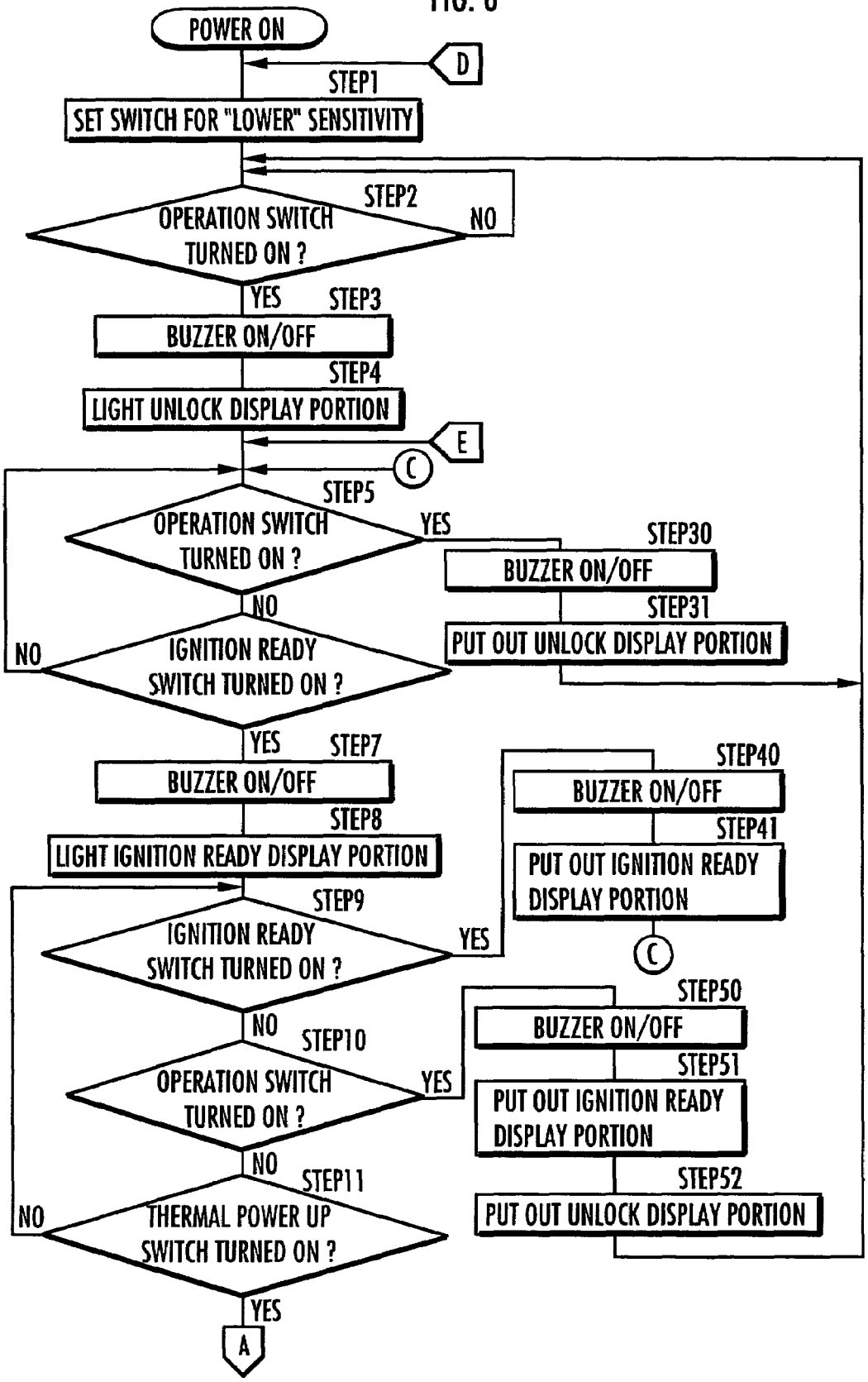
FIG. 6 is a flowchart of control performed in the cooking stove.
Figure 7:
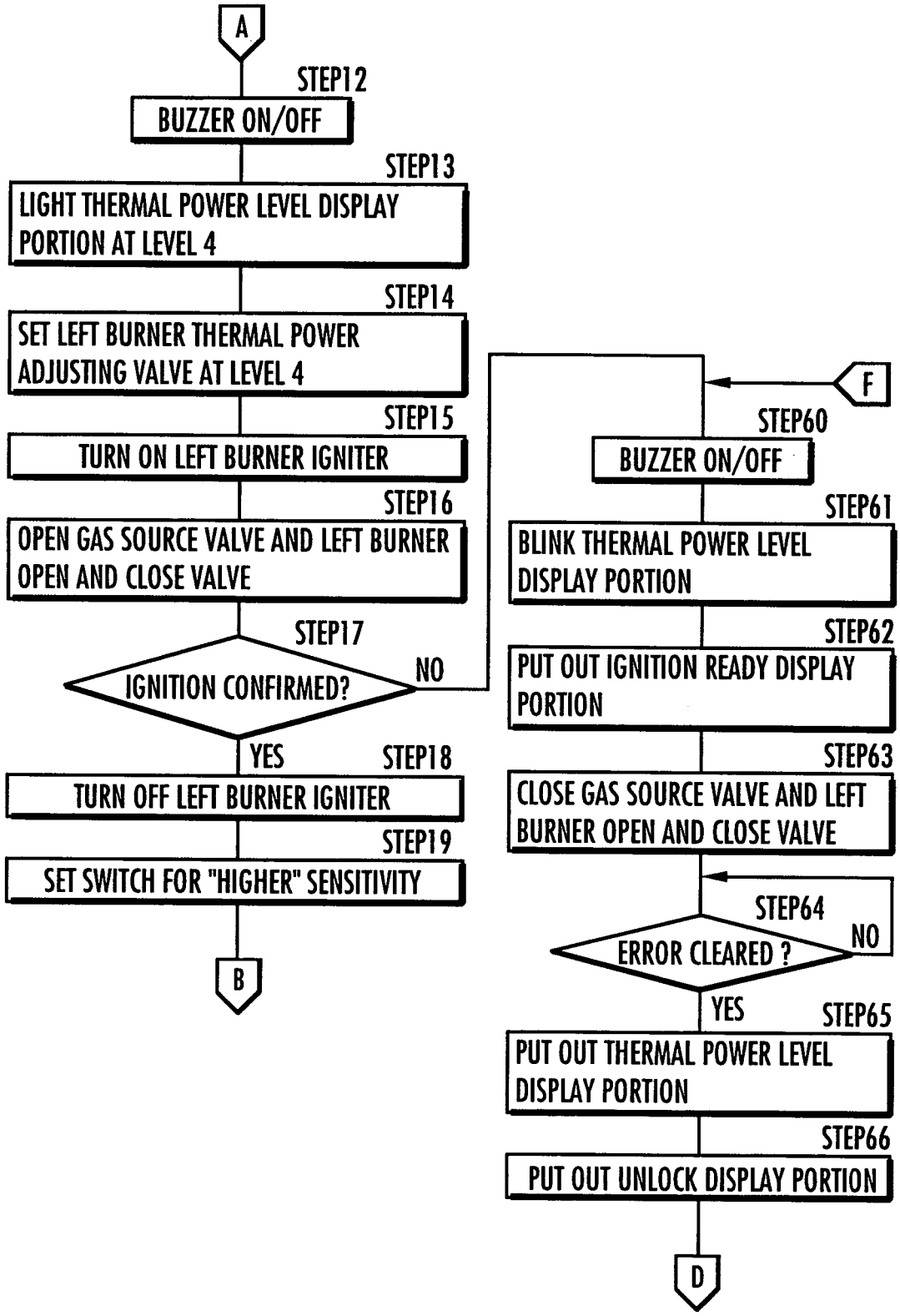
FIG. 7 is a flowchart of control performed in the cooking stove.
Figure 8:
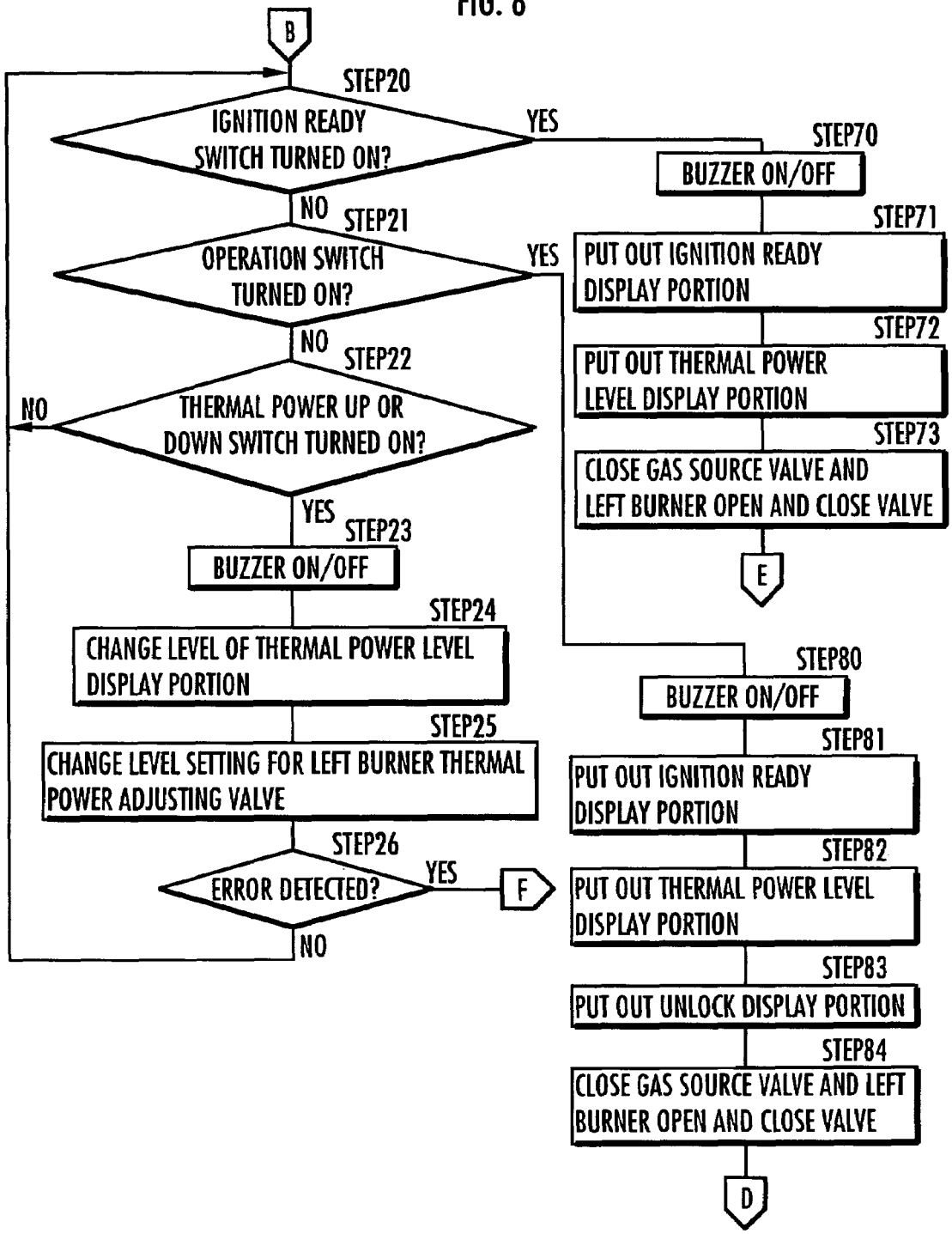
FIG. 8 is a flowchart of control performed in the cooking stove.

An embodiment of the present invention will be described with reference to FIGS. 1 to 8. FIG. 1 is a diagram showing the appearance of a cooking stove according to the present invention. FIG. 2 is a diagram showing the arrangement of a touch switch and a display section provided on a surface of the glass top plate shown in FIG. 1. FIG. 3 is a block diagram of control in the cooking stove. FIG. 4 is a sectional view of the touch switch. FIG. 5 is a diagram showing the configuration of the touch switch. FIGS. 6 to 8 are flowcharts of the control in the cooking stove.

FIG. 1 shows a drop-in cooking stove in which a glass top plate 2 formed of light-transmissive crystallized glass that is resistant to heat is installed on a top surface of a cooking stove main body 1. A lateral pair of cooking stove openings 3*a* and 3*b* is formed in the glass top plate 2. A left burner 4*a* and a right burner 4*b* (corresponding to heating means according to the present invention) are provided in the cooking stove main body 1 so as to face the respective cooking stove openings 3*a* and 3*b*. Trivets 5*a* and 5*b* are arranged on the cooking stove openings 3*a* and 3*b*, respectively, so that cooking containers can be placed on the trivets 5*a* and 5*b*. An operation portion 6 is provided in the top front side of the glass top plate 2 to instruct the left burner 4*a* and the right burner 4*b* to be actuated.

Reference is made to FIG. 2. The operation portion 6 comprises an operation switch 10 (corresponding to an electrical capacitance touch switch which allows a user of the present invention to instruct the heating means to change from a stopped state to an actuated state and from an actuated state to a stopped state) that can switch between an "operation state" in which the left burner 4*a* and the right burner 4*b* can be instructed to be actuated and a "standby state" in which the instruction is disabled, while the cooking stove main body 1 remains powered on. Further, to instruct the left burner 4*a* to be actuated, the operation portion 6 is provided with an ignition ready switch 11*a* (corresponding to the electrical capacitance touch switch which allows the user of the present invention to instruct the heating means to change from the stopped state to the actuated state and from the actuated state to the stopped state) that prepares the left burner 4*a* for ignition, a thermal power down switch 12*a* and a thermal power up switch 13*a* that switches the thermal power of the left burner 4*a* among five levels (levels 1 to 5), an ignition ready display portion 14*a* lighted while the left burner 4*a* is ready for ignition and while it is in operation, and a thermal power level display portion 15*a* that displays a thermal power setting for the left burner 4*a*.

When the thermal power up switch 13*a* is operated while the left burner 4*a* is ready for ignition, a process for igniting the left burner 4*a* is executed. When the ignition ready switch 11*a* or the operation switch 10 is operated while the left burner 4*a* is in operation, a process for extinguishing the left burner 4*a* is executed.

Similarly, to instruct the right burner 4*b* to be actuated, the operation portion 6 is provided with an ignition ready switch 11*b* (corresponding to the electrical capacitance touch switch which allows the user of the present invention to instruct the heating means to change from the stopped state to the actuated state and from the actuated state to the stopped state) that prepares the right burner 4*b* for ignition, a thermal power down switch 12*b* and a thermal power up switch 13*b* that switch the thermal power of the right burner 4*b* among five levels (levels 1 to 5), an ignition ready display portion 14*b* lighted while the right burner 4*b* is ready for ignition and while it is in operation, and a thermal power level display portion 15*b* that displays a thermal power setting for the right burner 4*b*.

When the thermal power up switch 13*b* is operated while the right burner 4*b* is ready for ignition, a process for igniting the right burner 4*b* is executed. When the ignition ready switch 11*b* or the operation switch 10 is operated while the right burner 4*b* is in operation, a process for extinguishing the right burner 4*b* is executed.

Moreover, the operation portion 6 is provided with an unlock display portion 16 lighted in the "operation state" and a lock display portion 17 lighted when the operation switch 10 is continuously operated for at least a predetermined time (for example 4 seconds) to bring the cooking stove into what is called a child lock state in which none of the switches can be operated.

Each of the switches in the operation portion 6 is a contactless touch switch composed of a capacitance detecting portion provided on a back surface of the glass plate 2 and a touch area corresponding to each switch mark printed on that part of a front surface of the glass top plate 2 which is opposite to an electrode pattern (described later in detail) of the capacitance detecting portion. When an electrostatic object is placed in the touch area, the capacitance detecting portion detects the electrostatic object to turn on the touch switch (this corresponds to a sensing state according to the present invention). On the other hand, while no electrostatic object is in the touch area, the capacitance detecting portion does not detect any electrostatic object, thus keeping the touch switch off (this corresponds to a non-sensing state according to the present invention).

Each display portion of the operation portion 6 is composed of a LED provided on the back surface of the glass top plate 2 and a print portion printed on the part of the front surface of the glass top plate 2 which is opposite to the LED. Turning on the LED lights the display portion. Turning off the LED turns off the display portion.

The thermal power level display portion 15*a* indicates the thermal power level (level 1 to 5) of the left burner 4*a* using the number of lighting portions incrementally lighted starting with the leftmost one; the total number of lighting portions is five and the lighting portions are provided in a bar display shown in the figure. For example, when the thermal power level of the left burner 4*a* is 1, only the lighting portion at the left end of the bar display is lighted. When the thermal power level of the left burner 4*a* is 5, all the five lighting portions in the bar display are lighted. Likewise, the thermal power level display portion 15*b* indicates the thermal power level (level 1 to 5) of the right burner 4*b* using the number of lighting portions incrementally lighted starting with the leftmost one; the total number of lighting portions is five and the lighting portions are provided in a bar display shown in the figure.

Now, reference is made to FIG. 3. A control circuit board 30 is provided in the cooking stove main body 1 to control the general actuation of the cooking stove. Both operation circuit board 50 and display circuit board 60 are bonded to the back surface of the glass top plate 2 using double coated tape.

A detection signal for an electrostatic object obtained by any of the following components is input to the control circuit board 30; an operation switch detecting portion 20, a left burner ignition ready switch detecting portion 21*a*, a left burner thermal power up switch detecting portion 23*a*, a left burner thermal power down switch detecting portion 22*a*, a right burner ignition ready switch detecting portion 21*b*, a right burner thermal power up switch detecting portion 23*b*, and a right burner thermal power down switch detecting portion 22*b* all of which constitute the capacitance detecting portion placed in the operation circuit board 50 in association with the touch areas of the respective switches (operation switch 10, ignition ready switches 11*a* and 11*b*, thermal power down switches 12*a* and 12*b*, and thermal power up switches 13*a* and 13*b*) of the operation portion 6.

Control signals output by the control circuit board 30 control the actuation of a gas source valve 40 that allows and inhibits the supply of fuel gas to the cooking stove main body 1, a left burner open and close valve 41*a* that allows and inhibits the supply of fuel gas to the left burner 4*a*, a left burner thermal power adjusting valve 42*a* that varies the flow rate of fuel gas supplied to the left burner 4*a*, a left burner igniter 43*a* that applies a high voltage to an ignition electrode (not shown) for the left burner 4*a* to cause spark discharge, a right burner open and close valve 41*b* that allows and inhibits the supply of fuel gas to the right burner 4*b*, aright burner thermal power adjusting valve 42*b* that varies the flow rate of fuel gas supplied to the right burner 4*b*, and a right burner igniter 43*b* that applies a high voltage to an ignition electrode (not shown) for the right burner 4*b* to cause spark discharge.

Moreover, control signals output by the control circuit board 30 control turn-on and -off of the LEDs (not shown) provided in the display circuit board 60 in association with the print portions of each of the display portions (ignition ready display portions 14*a* and 14*b*, thermal power level display portions 15*a* and 15*b*, unlock display portion 16, and lock display portion 17) provided in the operation portion 6, as well as turn-on and -off of a buzzer 18.

The control circuit board 30 comprises heating control means 31 for controlling the actuation of the left burner 4*a* and right burner 4*b*, lighting control means 32 for controlling lighting and extinction of each display portion provided in the operation portion 6 and causing the buzzer 18 to give warning, and switch sensitivity control means 33 for controlling the sensitivity of each operation switch. The sensitivity of each touch switch is switched by a sensitivity switch signal sch_sig output by the control circuit board 30 to the operation circuit board 50.

FIG. 4 is a sectional view of the operation switch 10. The operation circuit board 50 is bonded to the irregular back surface of the glass top plate 2 via a non-conductive pressure sensitive adhesive double coated tape 95; an operation switch mark 10*a* is provided on the back surface. An electrode pattern 51*d* (corresponding to an electrode having a gap according to the present invention) is formed on a part of the operation circuit board 50 which is opposite to the operation switch mark 10*a* via the glass top plate 2. Thus, when a finger F of the user which is an electrostatic object approaches or contacts the operation switch mark 10*a*, the capacitance within the electrode pattern 51*d* changes. Electrode patterns are also provided on the parts of the operation circuit board 50 which are opposite to the other switch marks.

Now, reference is made to FIG. 5(*a*). The operation switch detecting portion 20 comprises resistance elements 61 and 62 connected to one end of the electrode pattern 51*d*, a switch circuit 63 that selectively connects the resistance elements 61 and 62 electrically to the oscillation circuit 64, and a sensing circuit 65. The oscillation circuit 64 outputs a pulse signal of a frequency proportional to the reciprocal of a time constant $\tau$ (=C·R) obtained by multiplying the capacitance C within the electrode pattern 51*d* by the resistance value R of either of the resistance elements 61 and 62, switched by the switch circuit 63. The resistance value of the resistance element 61 is set higher than that of the resistance element 62.

For the sensing circuit 65, the capacitance within the electrode pattern 51*d* is a reference capacitance (corresponding to a second reference capacitance according to the present invention) set on the basis of a finger of a child. A preset reference frequency is the frequency of a pulse signal output by the oscillation circuit 64 when the switch circuit 63 selects the resistance element 62, which offers the lower resistance.

When the frequency of the pulse signal output by the oscillation circuit 64 becomes equal to or smaller than the reference value, the sensing circuit 65 outputs a sensing signal sen_sig to an input port I/O_2 of the control circuit board 30. Thus, the control circuit board 30 checks whether or not the sensing signal sen_sig is present to determine whether the operation switch 10 is in the sensing state or in the non-sensing state.

Further, the switch circuit 63 switches between the state in which the resistance element 61 is chosen (the resistance element 61 is electrically connected to the oscillation circuit 64) and the state in which the resistance element 62 is chosen (the resistance element 62 is electrically connected to the oscillation circuit 64) depending on the presence of the sensitivity switch signal sch_sig, output from an output port I/O_1 of the control circuit board 30.

Here, since the frequency of the pulse signal is proportional to the reciprocal of the time constant $\tau$, it is lower when the switch circuit 63 selects the resistance element 61, which offers the higher resistance, than when the switch circuit 63 selects the resistance element 62, which offers the lower resistance. Accordingly, the contact of an electrostatic object having a lower capacitance causes the oscillation circuit 64 to output a pulse signal of a frequency equal to or lower than the reference value when the switch circuit 63 selects the resistance element 61, which offers the higher resistance rather than when the switch circuit 63 selects the resistance element 62, which offers the lower resistance. As a result, the sensing circuit 65 outputs a sensing signal sen_sig.

Consequently, the switch sensitivity control means 33 provided on the control circuit board 30 can switch the sensitivity of the operation switch 10 by switching the resistance element (resistance element 61 or 62) selected by the switch circuit 63 in accordance with the output of the sensitivity switch signal sch_sig. Specifically, when the switch circuit 63 chooses the resistance element 61 with the higher resistance, a "higher sensitivity set state" is established in which the operation switch 10 has a higher sensitivity. When the switch circuit 63 chooses the resistance element 62 with the lower resistance, a "lower sensitivity set state" is established in which the operation switch 10 has a lower sensitivity.

The lower limit value for capacitance at which the operation switch 10 is turned on in the "lower sensitivity set state" corresponds to a first reference capacitance according to the present invention. The lower limit value for capacitance at which the operation switch 10 is turned on in the "higher sensitivity set state" corresponds to a second reference capacitance according to the present invention. The other switch detecting portions (see FIG. 3) are configured in the same manner.

Further, switch sensitivity varying means according to the present invention is composed of the switch sensitivity control means 33 provided on the control circuit board 30, and the switch circuit 63 and resistance elements 61 and 62 for each touch switch provided on the operation circuit board 50.

Now, in accordance with the flowcharts shown in FIGS. 6 to 8, description will be given of the control performed by the control circuit board 30 on the actuation of the left burner 4*a*. The actuation of the right burner 4*b* is controlled similarly.

When the cooking stove main body 1 is powered on to start supplying power to the control circuit board 30, the control circuit board 30 starts to be actuated. In STEP 1 in FIG. 6, the switch sensitivity control means 33 stops the output of the sensitivity switch signal sch_sig and sets the switches (operation switch 10, left burner ignition ready switch 11*a*, left burner thermal power up switch 13*a*, left burner thermal power down switch 12*a*, right burner ignition ready switch 11*b*, right burner thermal power up switch 13*b*, and right burner thermal power down switch 12*b*) in the "lower sensitivity set state".

Thus, even if a child touches, with his or her finger, any switch area being set in the operation portion 6, the touch switch remains in the non-sensing state. This prohibits the execution of a process from STEP 2 to STEP 18 shown in FIG. 7 if a child plays with or inadvertently touches any touch switch; the process is required to ignite the left burner 3*a*.

On the other hand, when an adult touches the touch area of the operation switch 10, the operation switch is turned on in STEP 2 even in the "lower sensitivity set state". The process then advances to STEP 3. Processing in STEP 3 and STEP 4 is executed by the lighting control means 32 (see FIG. 3). In STEP 3, the lighting control means 32 activates the buzzer 18 (see FIG. 3). In STEP 4, the lighting control means 32 lights the unlock display portion 16 (see FIG. 2) to notice the user that the "standby state" has been switched to the "operation state".

The heating control means 31 then executes a loop consisting of STEP 5 and STEP 6 to wait for the operation switch 10 to be turned on in STEP 5 or for the ignition ready switch 11*a* to be turned on in STEP 6. When the operation switch 10 is turned on in STEP 5, the process branches to STEP 30. Processing in STEP 30 to STEP 31 is executed by the lighting control means 32. In STEP 30, the lighting control means 32 activates the buzzer 18. In STEP 31, the lighting control means 32 puts out the unlock display portion 16 to notice the user that the stove has been switched to the "standby state". The process then returns to STEP 2.

On the other hand, when the ignition ready switch 11*a* is turned on in STEP 6, the process advances to STEP 7. Processing in STEP 7 to STEP 8 is executed by the lighting control means 32. In STEP 7, the lighting control means 32 activates the buzzer 18. In STEP 8, the lighting control means 32 lights the ignition ready display portion 14*a* to notice the user that the stove has been switched to the "ignition ready state", in which the thermal power up switch 13*a* can be operated to instruct the left burner 4*a* to be ignited.

The heating control means 31 then executes a loop consisting of STEP 9 to STEP 11 to wait for the ignition ready switch 11*a* to be turned on in STEP 9, for the operation switch 10 to be turned on in STEP 10, or for the thermal power up switch 13*a* to be turned on in STEP 11.

When the ignition ready switch is turned on in STEP 9, the process branches to STEP 40. Processing in STEP 40 and STEP 41 is executed by the lighting control means 32. In STEP 40, the lighting control means 32 activates the buzzer 18. In STEP 41, the lighting control means 32 puts out the ignition ready display portion 14*a* to notice the user that the "ignition ready state" has been cleared. The process then returns to STEP 5.

Further, when the operation switch 10 is turned on in STEP 10, the process branches to STEP 50. Processing in STEP 50 to STEP 52 is executed by the lighting control means 32. In STEP 50, the lighting control means 32 activates the buzzer 18. In STEP 51, the lighting control means 32 puts out the ignition ready display portion 14*a* and, in STEP 52, puts out the unlock display portion 16 to notice the user that the "ignition ready state" and the "operation state" have been cleared. The process then returns to STEP 2.

Furthermore, when the thermal power up switch 13*a* is turned on in STEP 11, the process advances to STEP 12 in FIG. 7. Processing in STEP 12 to STEP 13 is executed by the lighting control means 32. In STEP 12, the lighting control means 32 activates the buzzer 18. In STEP 13, the lighting control means 32 lights the thermal power level display portion 15*a* at a level 4 corresponding to the thermal level of the left burner 4*a* used for ignition. This notices the user that the igniting operation has been accepted.

In STEP 14 to STEP 18, the heating control means 31 executes a process of igniting the left burner 4*a*. In STEP 14, the heating control means 31 sets the left burner thermal power adjusting valve 42*a* at the level 4. In STEP 15, the heating control means 31 energizes the igniter 43*a* to allow a discharge electrode (not shown) to cause a spark discharge.

In STEP 16, the heating control means 31 opens the gas source valve 40 and the left burner open and close valve 41*a* to start supplying fuel gas to the left burner 4*a*. In STEP 18, the heating control means 31 checks whether or not the left burner 4*a* has been ignited. When the heating control means 31 determines that the left burner 4*a* has been ignited, the process advances to STEP 18. The heating control means 31 then turns off the left burner igniter 43*a* to finish the process of igniting the left burner 4*a*.

On the other hand, when the heating control means 31 cannot determine that the left burner 4*a* has been ignited, that is, the ignition has failed in STEP 17, the process branches to STEP 60. Processing in STEP 60 to STEP 62 is executed by the lighting control means 32. In STEP 60, the lighting control means 32 activates the buzzer 18. In STEP 61, the lighting control means 32 blinks the thermal power level display portion 15*a*, and in STEP 62, puts out the ignition ready display portion 14*a* to notice the user that the left burner 4*a* has failed to be ignited.

In STEP 63, the heating control means 31 closes the gas source valve 40 and the left burner open and close valve 41*a* to interrupt the supply of fuel gas to the left burner 4*a*. When an error clearance (resulting from operation of the operation switch 10) is sensed in STEP 64, the process advances to STEP 65. Processing in STEP 65 and STEP 66 is executed by the lighting control means 32. The lighting control means 32 puts out the thermal power level display portion 15*a* in STEP 65 and then the unlock display portion 16 in STEP 66 to notice the user that the stove has been switched to the "ready state". The process then returns to STEP 1 in FIG. 6.

When the lighting control means 32 determines that the left burner 4*a* has been ignited, in STEP 19, the switch sensitivity control means 33 outputs the sensitivity switch signal sch_sig. This sets the ignition ready switch 11*a* and the operation switch 10 in the "higher sensitivity set state"; the ignition ready switch 11*a* and the operation switch 10 can be used to instruct the left burner 4*b* to be extinguished. Thus, even when a child touches the touch area of the ignition ready switch 11*a* or operation switch 10, the corresponding touch switch is turned on.

Then, the heating control means 31 executes a loop of STEP 20 to STEP 22, shown in FIG. 8, and waits for one of the ignition ready switch 11*a*, operation switch 10, thermal power down switch 12*a*, and thermal power up switch 13*a* to be turned on.

In STEP 20, when the ignition ready switch 11*a* is turned on, the process branches to STEP 70. Processing in STEP 70 to STEP 72 is executed by the lighting control means 32. In STEP 70, the lighting control means 32 activates the buzzer 18. The lighting control means 32 then puts out the ignition ready display portion 14*a* in STEP 71 and then the thermal power level display portion 15*a* in STEP 72 to notice the user that the instruction on the extinction of the left burner 4*a* has been accepted and that the stove is to be switched to the "operation state". In STEP 73, the heating control means 31 closes the gas source valve 40 and the left burner open and close valve 41*a* to extinguish the left burner 4*a*. The process then returns to STEP 5 in FIG. 6.

Further, in STEP 21, when the operation switch 10 is turned on, the process branches to STEP 80. Processing in STEP 80 to STEP 83 is executed by the lighting control means 32. In STEP 80, the lighting control means 32 activates the buzzer 18. The lighting control means 32 then puts out the ignition ready display portion 14*a* in STEP 81, then the thermal power level display portion 15*a* in STEP 82, and the unlock display portion 16 in STEP 83 to notice the user that the instruction on the extinction of the left burner 4*a* has been accepted and that the stove is to be switched to the "ready state". In STEP 84, the heating control means 31 closes the gas source valve 40 and the left burner open and close valve 41*a* to extinguish the left burner 4*a*. The process then returns to STEP 1 in FIG. 6.

Furthermore, in STEP 11, when the thermal power up switch 13*a* or the thermal power down switch 12*a* is turned on, the process advances to STEP 23. Processing in STEP 23 and STEP 24 is executed by the lighting control means 32. In STEP 23, the lighting control means 32 activates the buzzer 18. In STEP 24, the lighting control means 32 changes the display level of the thermal power level display portion 15*a* (increases the level by one when the thermal power up switch 13*a* is turned on and reduces the level by one when the thermal power down switch 12*a* is turned on) to notice the user that the instruction on a change in thermal level of the left burner 4*a* has been accepted.

In STEP 25, the lighting control means 13 changes the set level of the left burner thermal power level adjusting valve 42*a* (increases the level by one when the thermal power up switch 13*a* is turned on and reduces the level by one when the thermal power down switch 12*a* is turned on). The process then advances to STEP 26. In STEP 26, if an error such as an accidental fire in the left burner 4*a* occurs, the process branches to STEP 60, where the processing in STEP 60 to STEP 66 is executed. That is, the user is noticed of the error and the left burner 4*a* is extinguished. On the other hand, if no error occurs in STEP 26, the process returns to STEP 20.

The operation of the operation switch 10 in STEP 2 and the operation of the ignition ready switch 11*a* in STEP 9 correspond to an instruction given by the user to switch the heating means from the stopped state to the actuated state according to the present invention. The operation of the ignition ready switch 11*a* in STEP 20 and the operation of the operation switch 10 in STEP 21 correspond to an instruction given by the user to switch the heating means from the actuated state to the stopped state according to the present invention.

FIG. 5(*b*) shows the transition of sensitivity of the ignition ready switch 11*a* and the operation switch 10 which transition occurs if the all the touch switches are set in the "lower sensitivity set state" in STEP 1, while the ignition ready switch 11*a* and the operation switch 10 are set in the "higher sensitivity set state" in STEP 19; the ignition ready switch 11*a* and the operation switch 10 can be used to instruct the left burner 4*b* to be extinguished. In FIG. 5(*b*), the axis of ordinate is set for the sensitivity of the ignition ready switch 11*a* and operation switch 10. The axis of abscissa is set for time t.

First, at a time $t_{10}$ when the control circuit board 30 starts to be actuated, the sensitivity of the ignition ready switch 11*a* and operation switch 10 becomes sl corresponding to the "lower sensitivity set state". Then, at a time $t_{11}$ when the left burner 4*a* is ignited, the sensitivity of the ignition ready switch 11*a* and operation switch 10 becomes sl corresponding to the "higher sensitivity set state". Subsequently, at a time $t_{12}$ when the left burner 4*a* is extinguished, the sensitivity of the ignition ready switch 11*a* and operation switch 10 becomes sl corresponding to the "lower sensitivity set state".

Thus, between $t_{10}$ and $t_{11}$ and after $t_{12}$, the left burner 4*a* is inactive, so that the sensitivity of the ignition ready switch 11*a* and operation switch 10 decreases. This prohibits the process of igniting the left burner 4*a* from being started if a child touches any touch switch. On the other hand, between $t_{11}$ and $t_{12}$, the left burner 4*a* is active, so that the sensitivity of the ignition ready switch 11*a* and operation switch 10 increases. This allows the process of extinguishing the left burner 4*a* to be executed if a child touches the touch area of the ignition ready switch 11*a* or operation switch 10.

The present embodiment shows the cooking stove comprising the gas burners 4*a* and 4*b* as heating means according to the present invention. However, the present invention is applicable to a cooking stove comprising another type of heating means such as an electric heater.

Further, the present embodiment shows the cooking stove comprising the touch switches on the glass top plate 2.

However, the present invention is applicable to a cooking stove comprising touch switches on a front panel of the stove.

Furthermore, in the present embodiment, as shown in FIG. 5(*a*), the resistance elements 61 and 62, which are connected to the electrode pattern 10, are selectively switched to vary the frequency of a pulse signal output by the oscillation circuit 64, and thus the sensitivity of the touch switches. However, the sensitivity of the touch switches may be varied using another method.

What is claimed is:

1. A cooking stove comprising heating means, an electrical capacitance touch switch provided on a front panel of a cooking stove main body accommodating the heating means or on a top plate covering a top surface of the cooking stove main body, the touch switch allowing a user to instruct the heating means to switch from a stopped state to an actuated state and to instruct the heating means to switch from the actuated state to the stopped state, and heating control means for executing a process for actuating the heating means when the touch switch switches from a non-sensing state to a sensing state while the heating means is in the stopped state and executing a process for stopping the heating means when the touch switch switches from the non-sensing state to the sensing state while the heating means is in the actuated state, the cooking stove further comprising:

switch sensitivity varying means for, while the heating means is in the stopped state, setting the touch switch in a lower sensitivity set state in which the touch switch switches from the non-sensing state to the sensing state when an electrostatic object having a capacitance equal to or larger than a predetermined first reference value contacts or approaches a touch area, and while the heating means is in the actuated state, setting the touch switch in a higher sensitivity set state in which the touch switch switches from the non-sensing state to the sensing state when an electrostatic object having a capacitance equal to or larger than a predetermined second reference value contacts or approaches the touch area, the second reference value being smaller than the first reference value.

2. The cooking stove according to claim 1, wherein the touch switch comprises a touch area set at a predetermined position on the front panel or the top plate, an electrode having a gap and provided opposite to the touch area via the front panel or the top plate, a resistance element connected to the electrode, and an oscillation circuit which outputs a pulse signal of a frequency corresponding to a time constant obtained by multiplying a capacitance within the electrode by a resistance value for the resistance element, the capacitance varying depending on the capacitance of the electrostatic object contacting or approaching the touch area, in order to sense the electrostatic object contacting or approaching the touch area by comparing the frequency of the pulse signal with a preset reference frequency to sense, and the switch sensitivity varying means varies the resistance value for the resistance element to switch between the lower sensitivity set state and the higher sensitivity set state.

* * * * *